US006055756A

United States Patent [19]

Aoki

[11] Patent Number: 6,055,756

[45] Date of Patent: May 2, 2000

[54] BAND FOR RECOGNITION

[75] Inventor: Gune Aoki, Ibaragi-ken, Japan

[73] Assignee: Sun Platech Co., Ibaragi-ken, Japan

[21] Appl. No.: 09/018,647

[22] Filed: Feb. 4, 1998

[51] Int. Cl.[7] ..... G09F 3/08

[52] U.S. Cl. ..... 40/633; 40/665; 292/307 A

[58] Field of Search ..... 40/633, 665; 292/307 R, 292/307 A, 314, 319, 325; 24/168 PB, 30.5 P; 283/75, 900

[56] References Cited

U.S. PATENT DOCUMENTS

| | | | |
|---|---|---|---|
| 3,020,657 | 2/1962 | Clark | 40/633 |
| 3,059,359 | 10/1962 | Goldammer et al. | 40/633 |
| 3,656,247 | 4/1972 | Bushnell et al. | 40/633 |
| 3,708,835 | 1/1973 | Bienz | 292/307 R X |
| 3,751,835 | 8/1973 | Smith | 40/633 |
| 5,740,623 | 4/1998 | Juhan et al. | 40/633 |

FOREIGN PATENT DOCUMENTS

| | | | |
|---|---|---|---|
| 2308153 | 11/1976 | France | 40/633 |

*Primary Examiner*—Brian K. Green

*Attorney, Agent, or Firm*—Arent Fox Kintner Plotkin & Kahn

[57] ABSTRACT

In a band for recognition, the present band for recognition comprises a flat plate shape display portion (2), a band portion (3) where multiple fixing holes (3*a*) are perforated, and a sealing portion (4), this sealing portion (4) including a male engagement portion (6) and a female engagement portion (7) arranged via a hinge portion (8), moreover, both engagement portion (6, 7) forming cutting rings (6*c*, 6*d*, 7*a*, 7*b*) around thin sheet portions (6*a*, 7*c*), and the biding force of the sealing portion (4) is made larger than the cutting force of the cutting rings (6*c*, 6*d*, 7*a*, 7*b*). As it can be used for recognition or identification wrapping around the wrist or the like of the visitor or others of various amusement parks, leisure land or the like, and once used and then detached from the wrist or the like, the sealing portion (4) will be broken and it can no more be reused.

5 Claims, 3 Drawing Sheets

BAND FOR RECOGNITION

FIELD OF THE INVENTION

The present invention relates to an improvement of a band for recognition used in order to verify the classification or the like: whether visitors and so on are legal visitor or not when they enter or exit various amusement parks, leisure land or the like.

BACKGROUND OF THE INVENTION

In various amusement parks, leisure land or event site or the like, a number of people enter or exit these places. So it becomes necessary to identify whether people gathering there are legal visitors or not, or are those belonging to a certain category or group or not, and to treat or arrange them according to the identification.

Generally, tickets, ID cards or the like are delivered to visitors, and they are requested to present it at respective places for identifying them by its indication contents, color or the like. On boarding a vehicle in an amusement park, stamping or punching of a ticket indicating menu or number of boarding of various vehicles or the like are generally executed for arranging visitors.

However, the tickets or ID cards are inconvenient to carry, easy to be lost and, particularly, they can not be adopted well by the children. Another control problem consists in that they can not permit to ensure whether they belong to the person who had paid the admission fee or not.

In order to solve these problems, it has been proposed to use an indication band in the form of arm band to be worn around the wrist, wherein vehicle menu or number of boarding or others are printed in its display portion.

This kind of indication band is provided with a pair of sealing portion composed of a male hook and a female hook, or an eyelet and a boss binding with the same disposed at its both ends and, when visitors enter the site, they wear this indication band around the wrist, bind and lock this sealing portion while the person in charge stamps with an oil-based ink pen the menu of vehicles or the number of boarding indicated on the display portion.

Though this kind of indication band provided with the sealing portion presents an advantage of being sealed securely when it is fitted to the wrist at the entrance, it is difficult to handle the band because it can not be detached without cutting it out by a cutter and, on the other hand, the use of cutter is dangerous and, moreover, extremely troublesome when a particularly large number of people are to be treated.

Besides, as structural problems, a band portion and the sealing portion are manufactured separately and then assembled together in relation to differences of their material or their strength. In other words, the band portion is manufactured by punching out a plastic sheet with a press, while the sealing portion uses an eyelet or hook manufactured by injection molding of synthetic resin or from metal and, the sealing portion is attached to the band portion manufactured as mentioned above to obtain the final product, thus increasing the manufacturing cost extremely.

As for problems on using it, the band portion manufactured by punching out a plastic sheet with a press has sharp edges, so the feeling is deteriorated and, particularly, soft skin of women and children may be damaged.

To avoid these problems, it has been proposed to melt and cut into the form of band by a melting cutter for obtaining a rounded edge viewed from the surface side; however it still presents a problem similar to the punched out band portion as the edge remains sharp viewed from the back side.

SUMMARY OF THE INVENTION

To overcome inconveniences of the prior art mentioned above, the band for recognition according to the present invention is composed as follows.

A) It comprises a flat plate shape display portion, a band portion extending from one end of this display portion and being perforated with multiple fixing holes, and a sealing portion provided at the other end of the display portion, this sealing portion including a male engagement portion and a female engagement portion arranged via a hinge portion, and moreover, both engagement portions forming cutting rings around thin sheet portions, and the biding force of the sealing portion is made larger than the cutting force of the cutting rings.

B) The cutting rings are formed by arranging arc slits annularly via the linkage portions.

C) Cutting lines are arranged and formed annularly in place of the cutting rings.

D) The display portion is composed to allow to be filled in by a writing implement or to be embossed with a symbol.

E) Besides, though it is preferable, in principle, to mold integrally the display portion, the band portion and the sealing portion, when it is necessary to make the display portion and the band portion soft and the sealing portion hard, a so-called "compound molding" may be adopted by molding, first, the sealing portion with hard resin, and then the display portion and the band portion with soft resin.

On the other hand, when a hook or the like having a particularly precise construction and high hardness is used, a so-called "insert molding" may be adopted by previously forming a sealing member such as hook with hard resin, secondly inserting the same in a mold, and then forming the display portion and the band portion with soft resin in a way to integrate with the sealing member.

The band for recognition according to the present invention is composed as mentioned before and used by having it around the wrist or others of an user like a watch strap and by binding the sealing portion. Then, to release this binding, it will be required to pull the end of the band portion and to cut the sealing portion at the cutting rings. As a result, once used and detached, this band can no more wrapped again around the wrist or others to reuse.

DESCRIPTION OF THE ILLUSTRATED EMBODIMENTS

Figure 1:
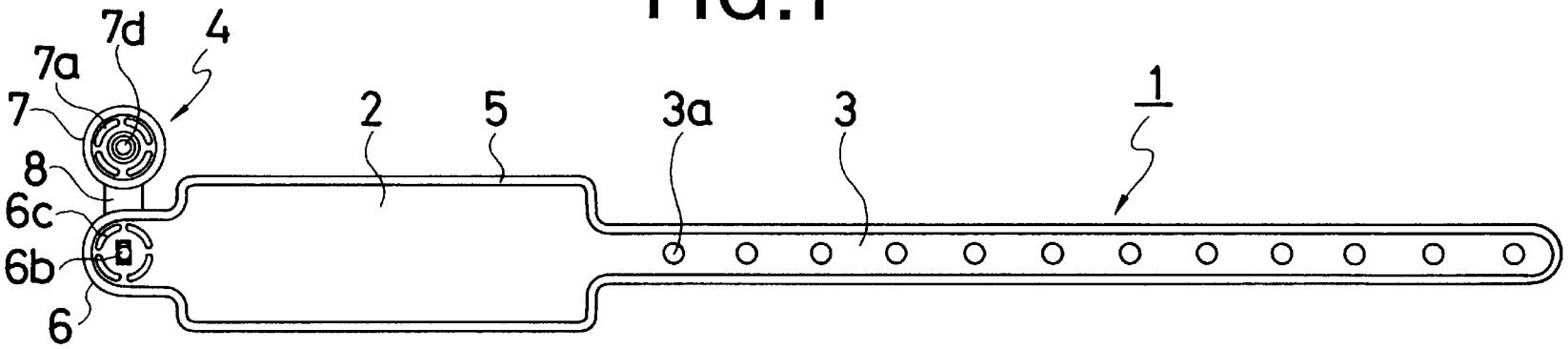
FIG. 1 is a front view of a band for recognition according to the present application.

Now an embodiment of the band for recognition according to the present invention will be described referring to the drawings.

Figure 2:
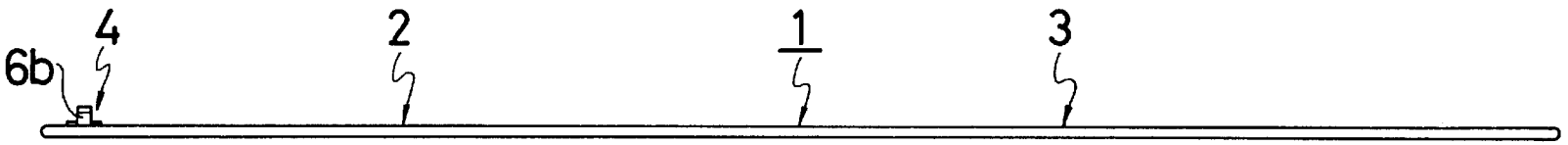
FIG. 2 is a side view of the band for recognition according to the present application.

FIG. 1 is a front view of a band for recognition, while FIG. 2 is a side view of the same, where a band 1 is, basically, an integral mold product, by injection molding of synthetic resin, wherein a sheet shape display portion 2 is formed at the center, a band portion 3 narrower than this display portion 2 is formed continuously over one end of this display portion 2, and a sealing portion 4 is formed at the other end of the display portion 2.

Figure 3:
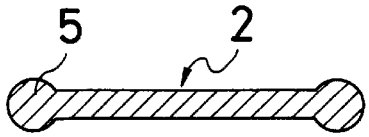
FIG. 3 is a cross-section view of the display portion.

Besides, as shown in FIG. 3, an edge portion 5 (hemming) presenting a substantially round section is disposed around the display portion 2 and the band portion 3 in order not to damage the users wrist.

The display portion 2 is formed as thin sheet shape or plate shape as shown in FIG. 3 to indicate by printing and displaying, for instance, on its surface the menu of the available vehicle or the open pavilions, or the number of boarding/admission or others.

As a consequence, the surface of this display portion 2 is surface treated by corona discharge treatment or the like for allowing to print something directly, processed by mat finish for forming fine unevenness like a tracing paper, or covered with printing ink or paint layer for allowing to be filled in by various writing implements.

Not only this display portion 2, but also the whole band 1 can be colored, or injection molded using colored resin with different colors according to the distinction of adult or child, or the distinction of the range of utilization.

Normally, this display portion 2 is rectangular, and a band portion 3 narrower than the same extends from one end thereof, fixing holes 3*a* are perforated with an appropriate interval over this band portion 3, and the band 1 is rolled around the wrist or the arm and locked by engaging this fixing hole 3*a* with a sealing portion 4 that will be described hereinafter.

Note that these display portion 2 and the band portion 3 may be modified conveniently in their width, length, thickness, and moreover, the configuration or the like according to the category of child or adult, man or women or others. To be more specific, a configuration designing animals or others for child are to be used while that of relatively narrow width is used for woman. On the other hand, when it is used for sport or other active objects, a robust, outstanding, wide and thick configuration should be adopted. In addition to the fixing hole 3*a*, multiple holes may also be perforated to afford ventilation to it.

Figure 4:
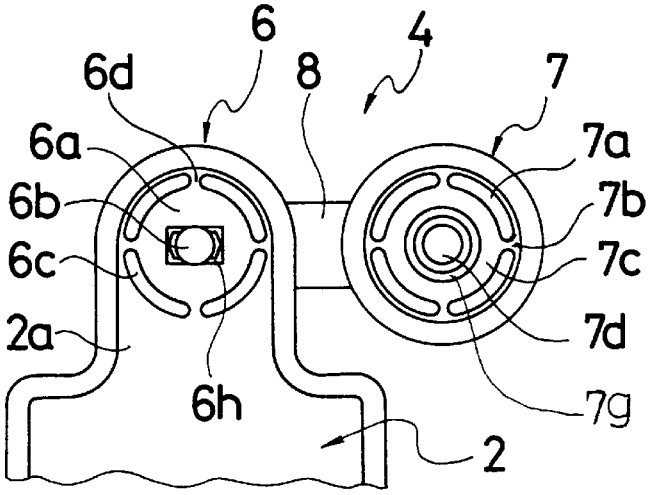
FIG. 4 is an enlarged front view of the sealing portion.
Figure 5:
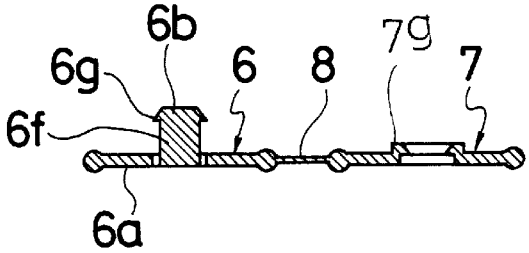
FIG. 5 is a cross-section view of the sealing portion shown in FIG. 4.

Next, as shown in FIG. 4, enlarged view and FIG. 5, cross-section view for this example, the sealing portion 4 is formed at the end of the display portion 2 via an extension portion 2*a* and composed to engage hook-shaped or eyelet-shaped male engagement portion 6 and female engagement portion 7 by folding them at a thin hinge portion 8.

In the male engagement portion 6 an engagement boss 6*b* protrudes at the center of a thin sheet portion 6*a*, arc slits 6*c* are arranged annularly around the thin sheet portion 6*a* and narrow linkage portions 6*d* are formed between the end portions of these slits 6*c*. When a tensile force is applied to the engagement boss 6*b*, this linkage portions 6*d* can be broken easily and the thin sheet portion 6*a* falls off with the engagement boss 6*b*. In other words, an annular portion composed of said slit portions 6*c* and linkage portions 6*d* forms a "cutting ring" in the present invention, and when the band 1 is rolled around the wrist or the like to be sealed, the linkage portions 6 will be broken if it is forced to be released, disabling to roll the band 1 around the wrist or the like to seal again; so the "cutting ring" functions as a kind of safety device.

Figure 6:
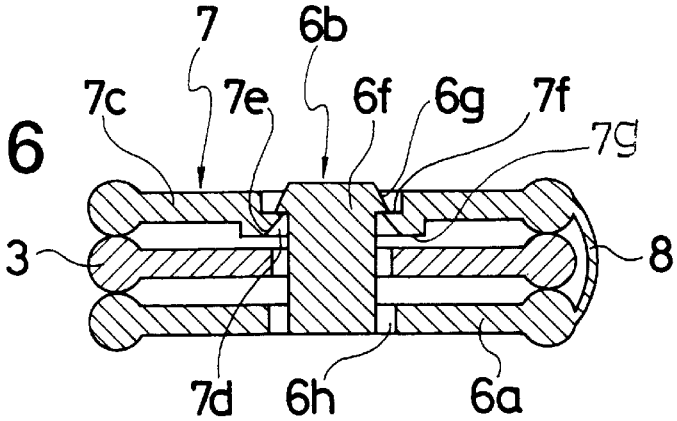
FIG. 6 is a cross-section showing the engaged state of the sealing portion.

In the engagement boss 6*b*, as shown in FIG. 5 and FIG. 6, a disk-shaped or linear-shaped locking edge 6g is formed at the upper end of a column portion 6*f*. Moreover, as shown in FIG. 4 and FIG. 6, slits 6h are formed at the root of the column 6*f*, in order to dispose metal mold members (not shown) for molding the locking edge 6*g* and are unnecessary from the structural view point.

On the other hands, as for the female engagement portion 7, a thin sheet portion 7*c* disposing arc slits 7*a* circumferentially and linkage portions 7*b* annularly between these slits 7*a* is formed, a round and thick locking portion 7*g* is formed at the center of this thin sheet portion 7*c*, and an engagement hole 7*d* is perforated at the center of this thick locking portion 7*g*. Besides, the annular portion composed of the slits 7*a* and the linkage portions 7*b* forms a second "cutting ring" to cooperate with said "cutting ring".

Additionally, as shown in FIG. 6, this engagement hole 7*d* forms a conical guiding face 7*e* for guiding the locking edge 6*g* of the engagement boss 6*b*, and a stop face 7*f* at the back side of this guiding face 7*e*, and when the engagement boss 6*b* is fitted into the engagement hole 7*d*, the engagement edge 6*g* of the engagement boss 6*b* engages securely with the stop face 7*f* to achieve the sealed state.

Further, as shown in FIG. 6, the engagement boss 6*b* having a hook-shaped section and a locking portion 7*g* having a hook-shaped section should be fitted together easily when the male engagement portion 6 is pressed against the female engagement portion 7 to fit each other, but once fitted, the hook-shaped engagement state can not be disengage, and the linkage portions 6*d*, 7*b* would be broken if it Is forced to be disengaged. Strength of the linkage portions 6*d*, 7*b* should be designed as described above.

On this engagement structure, though the illustrated one is most preferable, other forms may be used, and in short, any structure which makes the engagement force stronger than the strength of the linkage portions 6*d*, 7*d* connecting between slits 6*c*, 7*a* can be adopted.

As a consequence, in place of the slits 6*c*, 7*a* and the linkage portions 6*d*, 7*b* mentioned above, on the sealing portion 4 a ring-shaped thin portion, namely cutting line are formed, and it may composed to break starting from this cutting line, and moreover, multiple holes can be disposed in ring form to break starting from the linkage portion connecting these holes.

As for method for filling characters, symbols or the like in the display portion 2, writing implements can naturally be used, but a method wherein the display portion 2 is pressed or embossed to whiten that portion may well be adopted.

In this embodiment, an extension portion 2*a* is formed at one end of the display portion 2 (between that and the sealing portion 4), and depending on the application of the band 1, the length of the extension portion 2*a* can be further increased in band form by decreasing as much the length of the band portion 3, so that the end portion of the band portion 3 would not be piled up on the display portion 2 when the band 1 is rolled around the wrist or the like. On the contrary, the sealing portion 4 can be formed directly on the display portion 2 to secure the band 1 fixing.

In the embodiment, a method for injection molding in one-piece and at once the display portion 2, the band portion 3 and the sealing portion 4 has been described, but when it is impossible to afford required strength to the sealing portion 4 due to the insufficient resin strength, the "compound molding technology" or "various regins molding technology" will be adopted in such case.

In the compound molding technology or various regins molding technology, the essential portion (engagement boss 6*b* and locking portion 7*g*) of the sealing portion 4 are formed using a first relatively hard resin, such as polyacetal, in the first injection molding step shutting regin flow to the other portions except the essential portion. Then, the band 1 is completed by forming the display portion 2 and the band portion 3 by the way of enveloping the essential portion, using resin softer than the first resin, such as low density polyethylene, polyester elastomer, polyethylene elastomer or other resin, in the second injection molding step. Moreover, molding process in reverse order to mentioned above may be adopted.

In the compound molding, rotation of metal mold, changeover of resin, or other operations are required, but those of conventional molding methods can be used for this sake. In this way, the band 1 molded by using resins having different quality allows to engage the sealing portion 4 easily and surely just as the engagement of hook or eyelet.

Metal mold used for the compound molding or equipment for driving such metal mold tends to be rather complex and expensive. In order to overcome this inconvenience, hook, eyelet or other sealing member is previously molded with hard industrial resin. Then the band for recognition can be manufactured by inserting such sealing member between metal molds and molding the other portion with soft resin (Insert molding technology).

Figure 7:
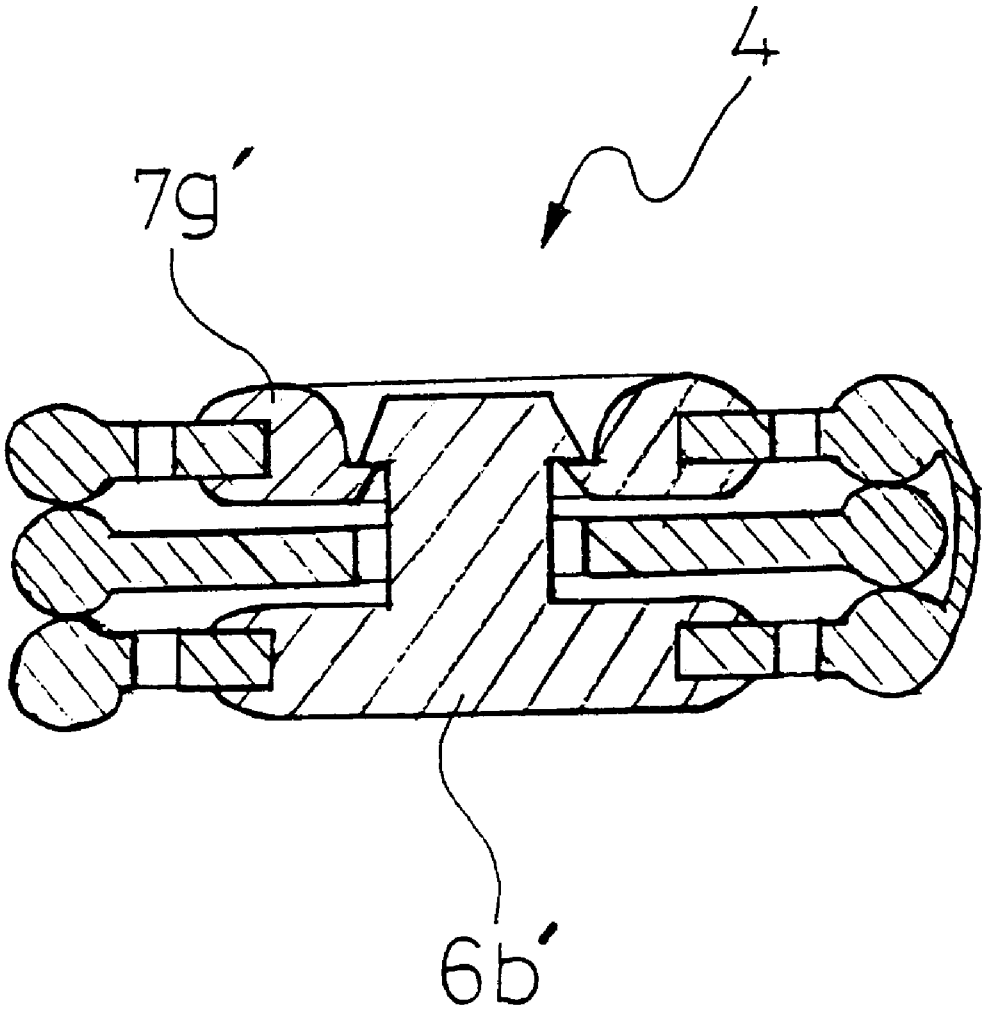
FIG. 7 is a cross-section showing the engaged state of the sealing portion with essential portion made of hard resin.

FIG. 7 shows the engaged state of the sealing portion 4 with the essential portion, namely the engagement boss 6*b*' and the locking portion 7*g*' made of hard regin through compound molding technology or insert molding technology.

Now, the method for using the band for recognition 1 composed as mentioned above shall be described.

First, the band 1 is applied around the wrist, and the engagement boss 6*b* of the male engagement portion 6 is fitted into a convenient fixing hole 3*a* of the band portion 3 according to the wrist size.

Then, the female engagement portion 7 is piled up over the male engagement portion 6 by folding the hinge portion 8, and the engagement boss 6*b* is pressed and inserted into the engagement hole 7*d*. Thus, the engagement edge 6*g* of the engagement boss 6*b* is guided with and slide over the conical guiding face 7*e* of the engagement hole 7*d* so as to be fitted with the stop face 7*f*. This state corresponds to the "sealed state" shown in FIG. 6, and once engaged in this state, the engagement state between the female engagement portion 7 and the male engagement portion 6 can no more be disengaged, and the band 1 will be held securely over the wrist.

Next, when the band 1 is to be removed from the wrist, the end portion of the band portion 3 is pulled out as if to peel off from the wrist. Then, as the thin sheet portion 7*c* of the female engagement portion 7 and the thin sheet portion 6*a* of the male engagement portion 6 are integrated sandwiching the band portion 3 as shown in FIG. 6, a portion of the "cutting rings" composed of the slit portions 6*c* and the linkage portions 6*d*, and also the slit portions 7*a* and the linkage portions 7*c* will be broken at once, and the both thin sheet portions 6*a*, 7*c* will be stripped off from the side of the display portion 2 in the state of attaching to the band portion 3. Thus the sealing state is broken, enabling to remove the band 1 from the wrist.

Once the sealing portion 4 is broken from the cutting rings, the portion 4 can no more be restored, being inhibited from reusing such band 1.

The band for recognition 1 according to the present invention composed as mentioned above can be used effectively in various amusement parks, leisure land, or event site, swimming pool, skiing ground, health center or other facilities gathering a number of people wherever they are.

It can also be used very effectively in the places where the distinction between a person and the other is critical, such as identification of new-born infant in the maternity hospital, patients in the hospital or victims in case of disaster.

Further, the band for recognition 1 according to the present invention may be used by printing characters, symbols, graphic or others in the display portion 2, and moreover, recognition bar code or electronic information may also be recorded and employed. Besides, not only the display portion 2 but also whole the band 1 can be colored with various colors in order to use effectively for recognition.

As display method, symbols or graphics may be whitened or protruded using an emboss implement.

The band for recognition according to the present invention composed as mentioned above does not detach itself once attached to the wrist or the like and the sealing portion made in sealed state. Consequently, this band for recognition can not be lost, stolen or used by the other, allowing to act safely.

For entering the site or leaving the site temporarily, one should only present this band attached to the wrist, so a great number of people passing through the entrance/exit of the site can be controlled easily.

After the use, the sealing portion can be broken easily via the cutting ring by pulling the band portion, so it can be removed easily without using a cutter or other dangerous tool.

The band wherein the sealing portion is thus broken through the cutting ring can not be reused, preventing illegal reuse of the used band, so the site administrator, organizer or entrepreneur can arrange and identify a great number of people securely.

Moreover, as the band is substantially made by injection molding of synthetic resin, it can be manufactured easily and effectively at a low price.

What is claimed is:

1. A band for recognition, comprising:

a flat plate shape display portion, a band portion extending from one end of said display portion and being perforated with multiple fixing holes, and a sealing portion provided at the other end of said display portion; wherein said sealing portion comprises a male engagement portion and a female engagement portion connected via a hinge portion, said male and female engagement portions each including thin sheet portions and breaking portions around said thin sheet portions, said breaking portions being formed by annularly arranging arc slits and linkage portions, whereby a binding force between said male and female engagement portions of said sealing portion is larger than a force sufficient to break said breaking portions.

2. The band for recognition according to claim 1, wherein the display portion is adapted to be filled in with a writing implement or to be embossed with a symbol.

3. The band for recognition according to claim 1, wherein essential portions of said male engagement and said female engagement portions are molded using hard resin, while other portions surrounding said essential portions are molded with relatively soft resin, said hard resin being polyacetal resin and said relatively soft resin being selected from the group consisting of low density polyethylene, polyester elastomer, and polyethylene elastomer.

4. The band for recognition according to claim 1, wherein a band extension portion is formed in a band shape between the display portion and the sealing portion.

5. The band for recognition according to claim 1, wherein an edge portion surrounding at least said display portion and said band portion is formed in a substantially round section having a thickness larger than the display portion and the band portion.

* * * * *